US009763315B2

(12) United States Patent
Stephani et al.

(10) Patent No.: US 9,763,315 B2
(45) Date of Patent: Sep. 12, 2017

(54) BEAM CURRENT VARIATION SYSTEM FOR A CYCLOTRON

(71) Applicant: VARIAN MEDICAL SYSTEMS PARTICLE THERAPY GMBH, Troisdorf (DE)

(72) Inventors: Thomas Stephani, Troisdorf (DE); Heinrich Rocken, Troisdorf (DE)

(73) Assignee: VARIAN MEDICAL SYSTEMS PARTICLE THERAPY GMBH, Troisdorf (DE)

( * ) Notice: Subject to any disclaimer, the term of this patent is extended or adjusted under 35 U.S.C. 154(b) by 0 days.

(21) Appl. No.: 14/760,404

(22) PCT Filed: Jan. 9, 2014

(86) PCT No.: PCT/EP2014/000027
§ 371 (c)(1),
(2) Date: Jul. 10, 2015

(87) PCT Pub. No.: WO2014/108334
PCT Pub. Date: Jul. 17, 2014

(65) Prior Publication Data

US 2015/0359081 A1 Dec. 10, 2015

(30) Foreign Application Priority Data

Jan. 10, 2013 (EP) ..... 13000127

(51) Int. Cl.
*H05H 7/00* (2006.01)
*H05H 7/08* (2006.01)
*H05H 13/00* (2006.01)

(52) U.S. Cl.
CPC ..... *H05H 7/08* (2013.01); *H05H 7/00* (2013.01); *H05H 13/005* (2013.01); *H05H 2007/085* (2013.01)

(58) Field of Classification Search
None
See application file for complete search history.

(56) References Cited

U.S. PATENT DOCUMENTS 8,053,746 B2 * 11/2011 Timmer ..... A61N 5/10 250/397
8,440,987 B2 * 5/2013 Stephani ..... H01J 3/14 250/492.1

(Continued)

FOREIGN PATENT DOCUMENTS

DE 20 2006 019 307 U1 5/2008
WO WO 2012/031299 A2 3/2012

OTHER PUBLICATIONS

Falbo, "Advanced Accelerator Technology Aspects for Hadrontherapy", Proceedings of HIAT 2012, Chicago, IL, USA, Aug. 2012, pp. 156-162.

(Continued)

*Primary Examiner* — Douglas W Owens
*Assistant Examiner* — Srinivas Sathiraju
(74) *Attorney, Agent, or Firm* — Shapiro, Gabor and Rosenberger, PLLC

(57) ABSTRACT

Beam current variation system for a cyclotron, arranged in the inner center of the cyclotron, downstream from the ion source generating the charged particle beam, the system comprising a deflector system powered by a voltage and a collimator. The beam is dumped in the collimator, if the deflector system (10; 20, 21) is not powered, and the beam is switched on by powering the deflector system with a voltage.

14 Claims, 5 Drawing Sheets

(56) References Cited

U.S. PATENT DOCUMENTS

| | | | | |
|---|---|---|---|---|
| 8,445,872 | B2 * | 5/2013 | Behrens | H01J 3/14 250/492.1 |
| 8,927,946 | B2 * | 1/2015 | Behrens | H01J 3/14 250/492.1 |
| 8,952,343 | B2 * | 2/2015 | Stephani | H01J 3/14 250/492.1 |
| 8,969,798 | B2 * | 3/2015 | Park | H01J 49/063 250/282 |
| 2005/0230614 | A1 * | 10/2005 | Glukhoy | H01J 49/40 250/287 |
| 2009/0321026 | A1 * | 12/2009 | Medoff | D21B 1/02 162/50 |
| 2012/0056099 | A1 * | 3/2012 | Behrens | H01J 3/14 250/396 R |
| 2012/0223246 | A1 * | 9/2012 | Stephani | H01J 3/14 250/396 R |
| 2013/0277569 | A1 * | 10/2013 | Behrens | H01J 3/14 250/396 R |
| 2013/0303824 | A1 * | 11/2013 | Stephani | H01J 3/14 600/1 |

OTHER PUBLICATIONS

Adachi et al., "Injection and Extraction System for the KEK Digital Accelerator", Proceedings IPAC'10, Kyoto, Japan, Jul. 2012, pp. 570-572.

Houck et al., "Choppertron II", Proceedings of PAC'95, Dallas, TX, USA, Jan. 1996, pp. 1524-1526.

International Search Report dated Mar. 11, 2014, in International Application No. PCT/EP2014/000027.

* cited by examiner

BEAM CURRENT VARIATION SYSTEM FOR A CYCLOTRON

FIELD OF THE INVENTION

The invention relates to a system for varying the beam current emitted from a cyclotron for use in particle therapy, in particular to a system to switch on and off the particle beam in short time.

BACKGROUND

Charged particle beams consisting of protons of heavier ions are successfully used in cancer therapy to destroy tumours by irradiation. A charged particle therapy system using a cyclotron to generate the charged particle beam is for example described in DE 20 2006 019 307. As described by E. Pedroni et al. (Med. Phys. 22 (1) 1995) charged particle therapy systems inter alia use scanning techniques to scan tumour volumes with a charged particle beam in order to effectively destroy the tumour while avoiding damages in neighbouring healthy tissue regions.

In the field of particle therapy, especially when using scanning techniques, it is necessary to switch on and off the beam very quickly, preferably within microseconds. Furthermore, the beam intensity must be adjusted in a wide range within short time, preferably within milliseconds.

In known charged particle therapy systems where the beam is provided by a cyclotron with a horizontal acceleration plane, the quick on/off switching of the beam and the quick adjusting of the beam intensity is done by use of an active vertical deflector system in the inner center of the cyclotron. Such deflector system usually consists of a vertical deflector with two deflector plates being arranged, with respect to the beam direction, downstream from the ion source in the acceleration plane in the very first turns before the beam is accelerated to high energies. In these known systems, if the vertical deflector is not powered, the beam passes straight through the deflector and through an aligned vertical collimator and proceeds to the further acceleration path. If, in these systems, the deflector is powered, the beam is deflected and partly or totally dumped in the vertical collimator. This means that the system requires a—usually high (some kV)—voltage to switch off the beam. With this design, the known vertical deflector systems are not fail-safe with respect to beam switch off. If the powering with a voltage fails, the beam may not be switched off.

BRIEF SUMMARY OF THE INVENTION

It is therefore an object of the present invention to provide a fail-safe system for varying the beam current, in particular for fail-safe switching on and off the beam.

According to the invention, this object is solved by the beam current variation system according to claim 1. Preferred aspects are subject to the dependent claims.

The beam current variation system of the invention is arranged in the inner center of the cyclotron, downstream from the ion source generating the charged particle beam. The system comprises a deflector system for deflecting the beam. The deflector system may consist of one or more deflectors made of a pair of preferably parallel deflector plates and/or one or more deflectors made of a single deflector plate and/or other means for deflecting the beam. The deflector system is powered by a voltage and the deflection may be changed by changing the voltage. The beam current variation system further comprises a collimator in correspondence with the deflector system. According to the invention, the deflector system and the collimator are designed and aligned in such way that the beam is dumped in the collimator, if the deflector system is not powered. By suitably powering the deflector system with a voltage, the beam may be switched on. This makes the beam current variation system fail-safe; if the voltage for powering the deflector system fails for some reason, the beam is automatically dumped in the collimator and thus switched off.

In a preferred aspect, the beam current variation system of the invention is designed in such way that, by varying the voltage powering the deflector system, the intensity of the beam current may be continuously varied.

In another preferred aspect, the deflector system comprises one deflector which is arranged, with respect to the beam direction, upstream from the collimator. Preferably, the deflector consists of a pair of deflector plates, and the beam enters into the deflector along the central plane of the deflector and/or perpendicular to the deflecting field generated by the deflector. The deflector and the collimator are disaligned with respect to the beam direction in such way that the beam is totally dumped in the collimator, if no voltage is applied to the deflector. Furthermore, the deflector and the collimator are aligned in such way that, by applying a suitable voltage to the deflector, the beam may pass through the collimator. In a variation of this preferred aspect, the beam enters into the deflector slantwise, i.e. with some inclination with respect to the central plane of the deflector and/or the direction of the deflecting field generated by the deflector.

In another preferred aspect, the deflector system comprises two deflectors with the collimator arranged between the deflectors such that a first deflector is arranged upstream from the collimator and a second deflector is arranged downstream from the collimator. The two deflectors and the collimator are aligned with respect to the beam in such way that the beam is totally dumped in the collimator, if the first deflector is not powered. If the first deflector is powered with a suitable voltage, the beam may pass the collimator. The second deflector is used to change the beam direction, preferably in order to bring the beam back towards to the original beam direction before entering the first deflector. Advantageously the beam is directed towards the acceleration plane of the cyclotron with the second deflector in order to feed the beam into the further acceleration path of the cyclotron.

In another preferred aspect, the deflector system comprises three or more deflectors arranged in correspondence with one or more collimators. One or more of these deflectors might consist of a pair of deflector plates.

In another preferred aspect, the beam current variation system is designed in such way that, after switching the beam on by deflection in the deflection system, the beam ends up in the acceleration plane of the cyclotron.

In another preferred aspect, one or more deflectors of the deflection system deflect the beam in a direction perpendicular to the acceleration plane.

In another preferred aspect, one or more deflectors of the deflection system deflect the beam laterally within the acceleration plane.

BRIEF DESCRIPTION OF THE DRAWINGS

Preferred embodiments of the invention will now be explained in detail below with reference to the figures, in which.

DETAILED DESCRIPTION

Figure 1:
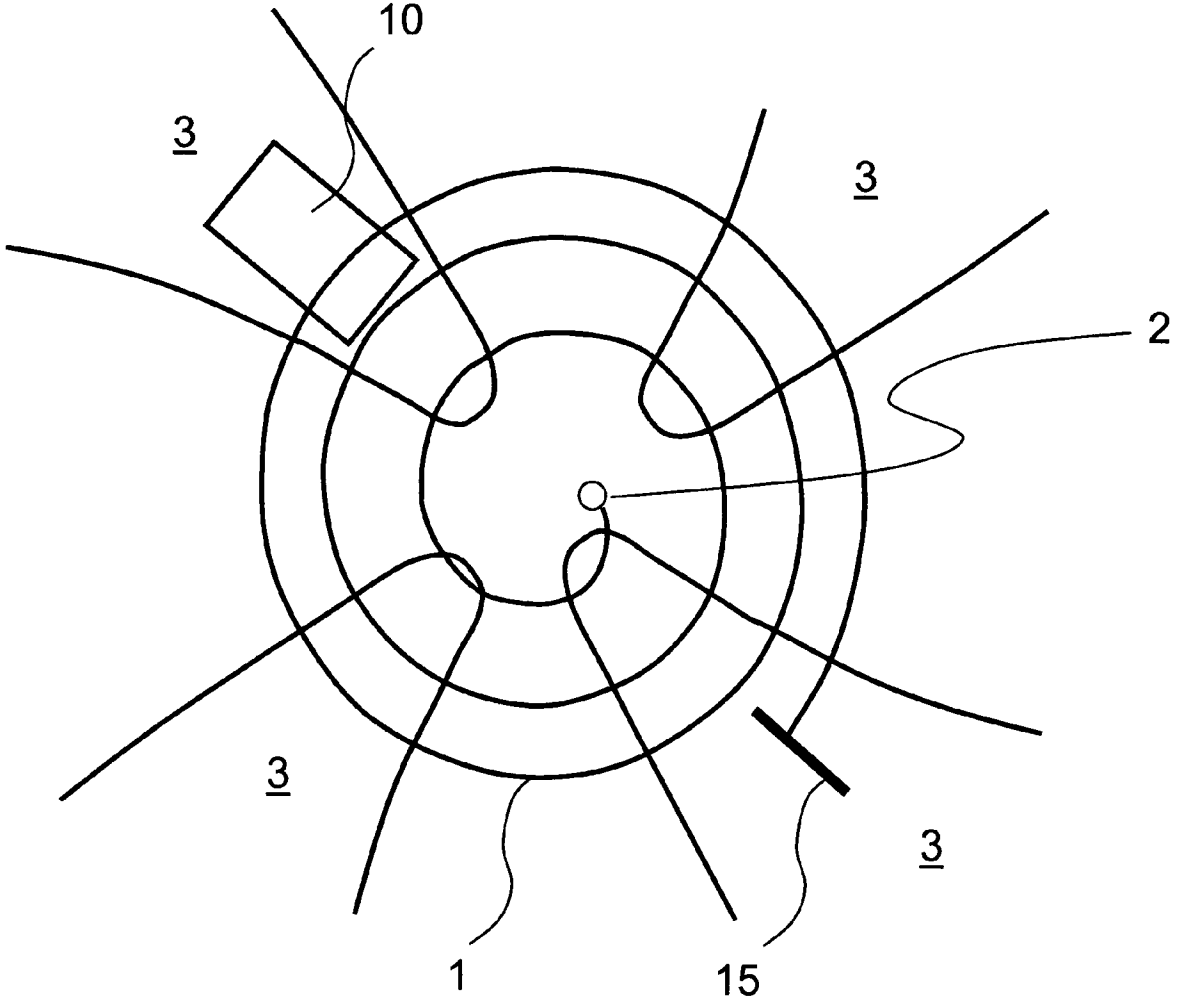
FIG. 1: shows a view onto the acceleration plane with the first few turns of the spiral beam path

FIG. 1 shows a view onto the first few turns of the beam 1 in the acceleration plane. The beam starts at the ion source 2 and follows a spiral beam path in the magnetic field generated by the—in this case four—dees 3 of the cyclotron. As shown in FIG. 1, the beam 1 passes through the deflector 10 consisting of a pair of deflector plates generating an electric field perpendicular to the acceleration plane. On its further path after the deflector 10, the beam 1 proceeds to the collimator 15.

Figure 2:
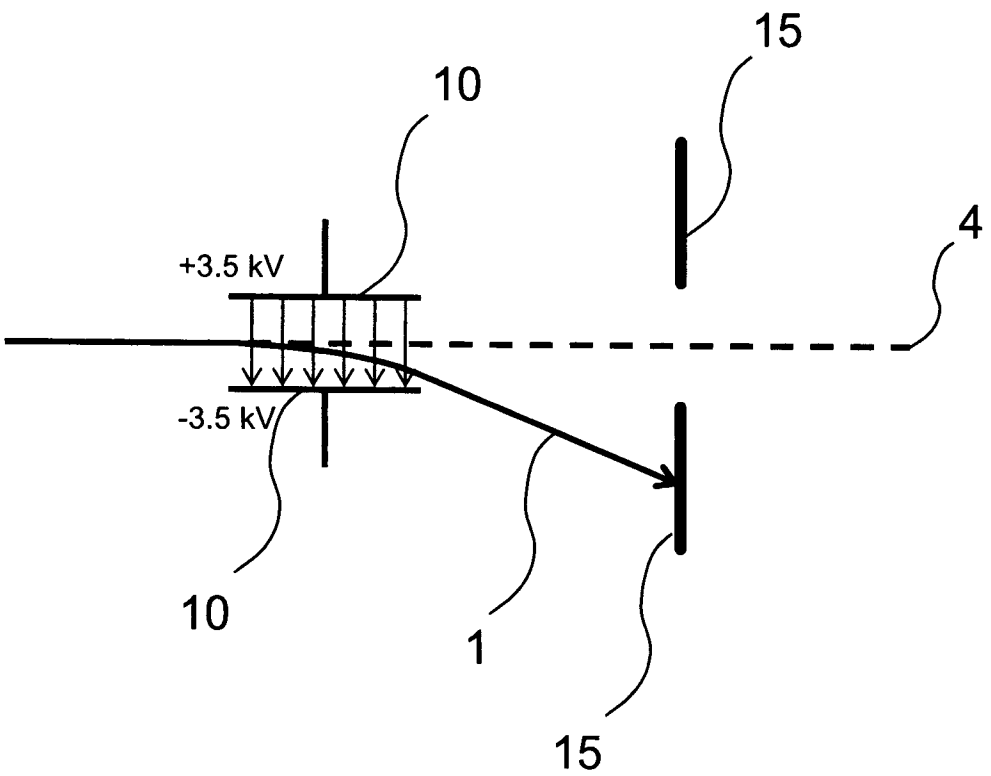
FIG. 2: shows, in a view parallel to the acceleration plane, the beam path through a deflector and collimator according to the prior art.

FIG. 2 shows in a view parallel to the acceleration plane 4 an arrangement of deflector 10 and collimator 15 according to the prior art. The deflector 10 consists of a pair of parallel deflector plates. The central plane of the deflector coincides with the acceleration plane 4. The beam 1 enters from the left-hand side into the deflector 10 along the central plane of the deflector and perpendicular to the electric field generated by the deflector. If the deflector is powered with a voltage of +/−3.5 kV the beam 1 is deflected in such way that it is totally dumped in the collimator 15. If no voltage is applied to the deflector 10, the beam 1 passes straight through the collimator 15 along the dashed line and proceeds to the further acceleration in the acceleration plane 4.

Figure 3:
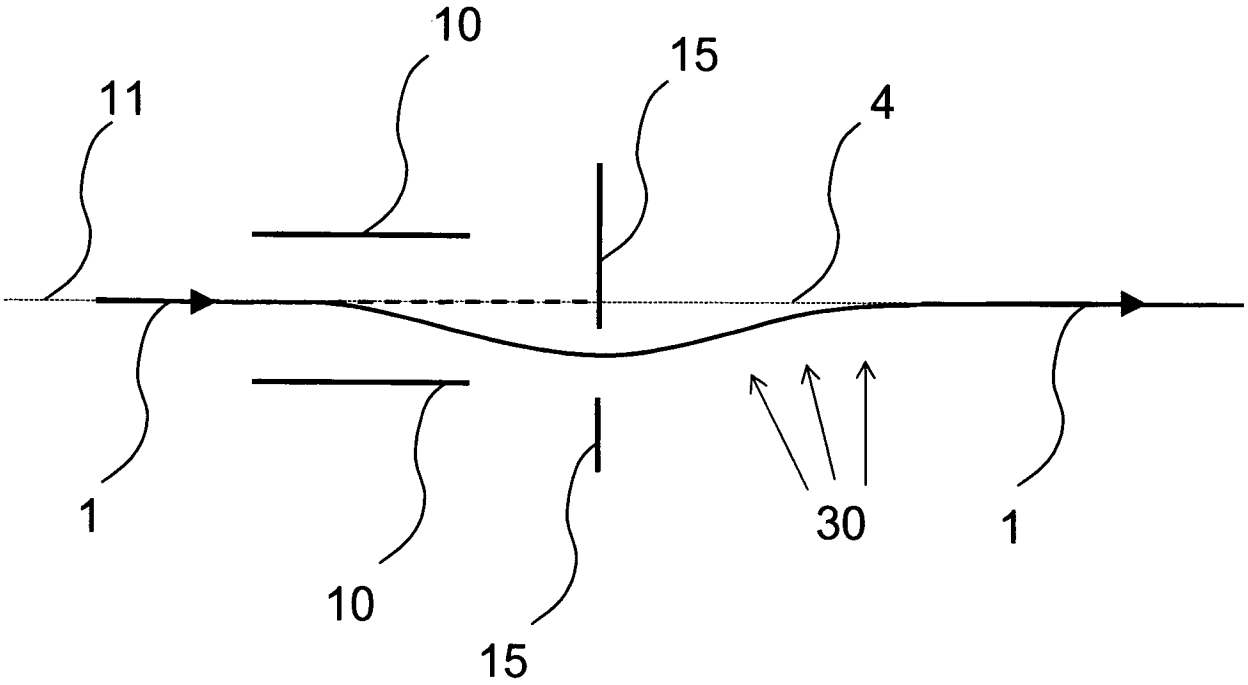
FIG. 3: shows the beam path through the deflector system and the collimator according to a first embodiment of the invention.

FIG. 3 shows a first embodiment of the invention, wherein the beam current variation system is formed by a deflector 10 and a collimator 15 arranged downstream from the deflector 10. The deflector 10 consists of a pair of parallel deflector plates and is powered by a voltage and deflects the beam by an electro-static field, if a voltage is applied. In FIG. 3, the charged particle beam, coming from the left, enters into the deflector 10 along the central plane 11 of the deflector 10, perpendicular to the electrostatic field generated by the deflector 10. If no voltage is applied to the deflector 10, the beam passes through the deflector on the dashed line, i.e. straight through along the central plane of the deflector 10. The collimator 15 is arranged in such way that the beam 1 is totally dumped in the collimator, if no voltage is applied to the deflector 10. This means that the deflector 10 and the collimator 15 are disaligned with respect to the beam 1 is such way that the beam is switched off, if the deflector is not powered. If a suitable voltage is applied to the deflector 10, the beam is deflected in such way that it traverses the deflector along the continuous beam line 1 and passes through the collimator 15 in order to proceed to the further acceleration in the acceleration plane 4 of the cyclotron. On this way, downstream from the collimator 15, the beam 1 may be focused and/or redirected in the region 30 in an electric and/or magnetic field.

By varying the voltage around the value where the beam passes the opening in the collimator, the intensity of the beam current may be continuously varied.

Figure 4:
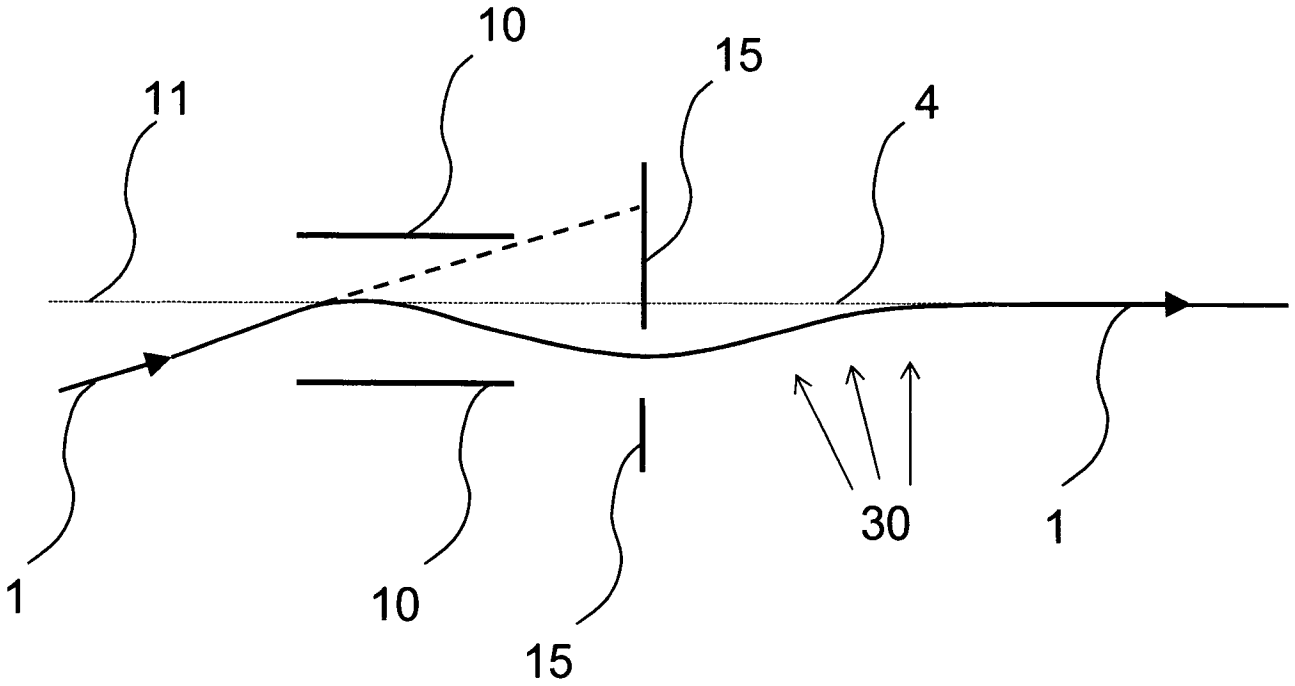
FIG. 4: shows the beam path through the deflector system and the collimator according to a second embodiment of the invention.

FIG. 4 shows a second embodiment of the invention, wherein the beam current variation system is also formed by a deflector 10 and a collimator 15 arranged downstream from the deflector 10. In this embodiment, as shown in FIG. 4, the beam 1, coming from the left, enters the deflector 10 slantwise, i.e. not parallel to the central plane 11 of the deflector, but with some inclination with respect to the electric field generated by the deflector 10. If no voltage is applied to the deflector 10, the beam passes through the deflector 10 on the dashed line, i.e. with some inclination with respect to the central plane 11 of the deflector 10. The collimator 15 is arranged in such way that the beam 1 is totally dumped in the collimator 15, if no voltage is applied to the deflector 10. This results in a beam switch off, if the deflector is not powered. If a suitable voltage is applied to the deflector 10, the beam 1 is deflected in such way that it traverses the deflector along the continuous beam line 1 and passes through the collimator 15 in order to further proceed to the further acceleration. On this way, downstream from the collimator 15, the beam 1 may be focused and/or redirected in the region 30 in an electric and/or magnetic field.

Figure 5:
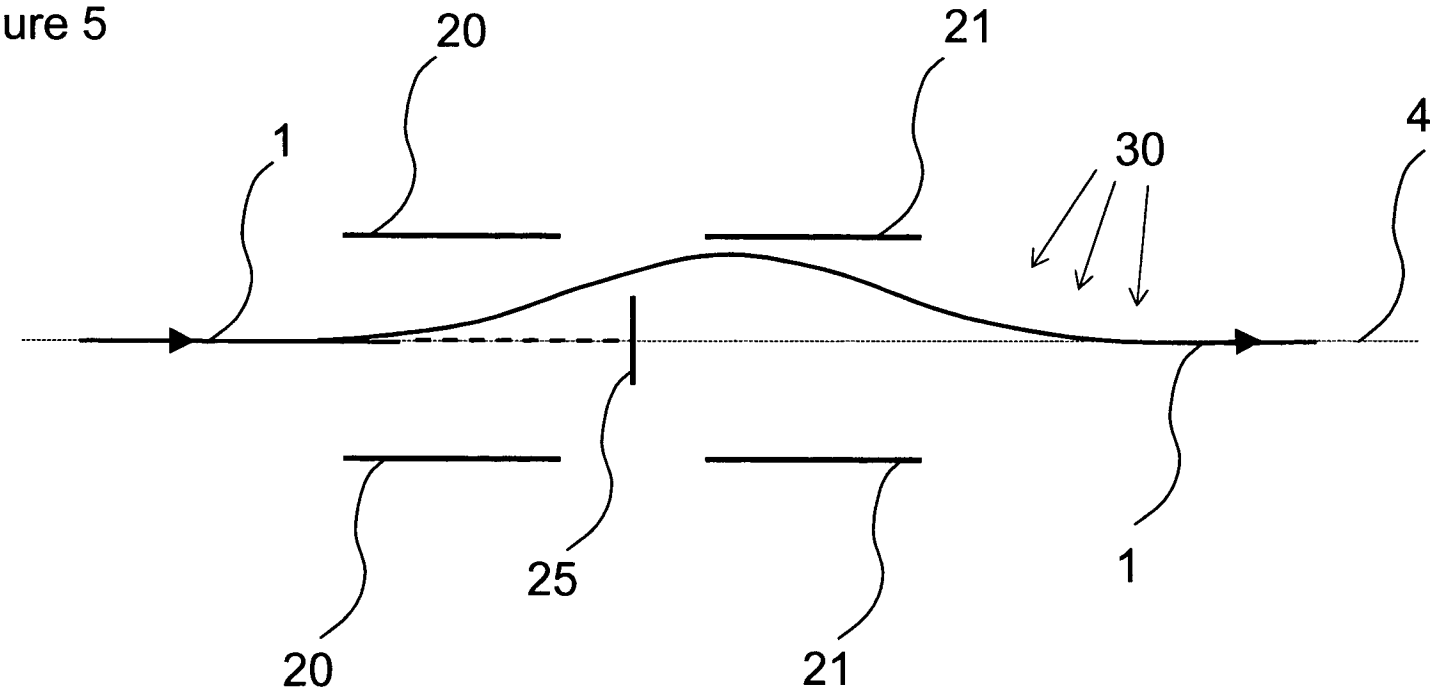
FIG. 5: shows the beam path through the deflector system and the collimators according to a third embodiment of the invention.

FIG. 5 shows a third embodiment of the invention, wherein the beam current variation system is formed by a first deflector 20, a collimator 25 arranged downstream from the first deflector 20, and a second deflector 21 arranged downstream from the collimator 25. The deflectors 20, 21 consist of pairs of parallel deflector plates and are powered by a voltage and deflect the beam 1 by an electrostatic field, if a voltage is applied. As shown in FIG. 5, the beam, coming from the left, enters the first deflector 20 in a direction perpendicular to the electric field along the central plane of the first deflector 20. If no voltage is applied to the first deflector, the beam 1 traverses the deflector on the dashed line, i.e. straight along the central plane of the deflector. The collimator 25 is aligned in such way that the beam 1 is totally dumped in the collimator, if no voltage is applied to the first deflector 20. This way the collimator is actually a beam dump. If a suitable voltage is applied to the first deflector 20, the beam 1 is deflected in such way that the beam 1 traverses the first deflector 20 along the continuous beam line. The beam is deflected in such way that it passes around the collimator 25 and enters into the second deflector 21. In the second deflector 21 the beam 1 is deflected in a direction back towards its original direction in order to proceed to the further acceleration in the acceleration plane 4. On this way, in the region 30 downstream from the second deflector 21, the beam may be focused and/or redirected in an electric and/or magnetic field.

The three preferred embodiments described above provide that the beam 1 is completely switched off if no voltage is applied to the deflector system 10 or 20, 21. Thus the invention provides the advantage of beam current variation system which is fail-safe with respect to switch off.

The invention claimed is:

1. A beam current variation system for a cyclotron, arranged in the inner centre of the cyclotron, downstream from an ion source generating a charged particle beam, the system comprising a deflector system powered by a voltage for deflecting the beam and a collimator, characterized in that the beam is dumped in the collimator, when the deflector system is not powered, and in that the beam is switched on by powering the deflector system with a voltage.

2. The beam current variation system according to claim 1, characterized in that a beam current intensity may be continuously varied by variation of the voltage powering the deflector system.

3. The beam current variation system according to claim 1, characterized in that the deflector system comprises a deflector arranged upstream from the collimator, wherein the beam enters into the deflector along a central plane of the deflector.

4. The beam current variation system according to claim 1, characterized in that the deflector system comprises a deflector arranged upstream from the collimator, wherein the beam enters into the deflector slantwise.

5. The beam current variation system according to claim 3, characterized in that the deflector and the collimator are dis-aligned in such a way that the beam is dumped in the collimator, when no voltage is applied to the deflector.

6. The beam current variation system according to claim 1, characterized in that the deflector system comprises a first deflector, arranged upstream from the collimator, and a second deflector, arranged downstream from the collimator, wherein the beam is dumped in the collimator, when the first deflector is not powered, and wherein the beam passes through the collimator, when the first deflector is suitably powered, and wherein the second deflector changes the beam direction towards an original beam direction which the beam had before entering the first deflector.

7. The beam current variation system according to claim 6, characterized in that the beam is directed towards an acceleration plane of the cyclotron with the second deflector.

8. The beam current variation system according to claim 1, characterized in that, after switching the beam on by deflection in the deflection system, the beam ends up in an acceleration plane of the cyclotron.

9. The beam current variation system according to claim 1, characterized in that one or more deflectors of the deflector system deflect the beam perpendicular to an acceleration plane.

10. The beam current variation system according to claim 1, characterized in that one or more deflectors of the deflector system deflect the beam laterally in an acceleration plane.

11. The beam current variation system according to claim 2, characterized in that the deflector system comprises a deflector arranged upstream from the collimator, wherein the beam enters into the deflector along a central plane of the deflector.

12. The beam current variation system according to claim 2, characterized in that the deflector system comprises a deflector arranged upstream from the collimator, wherein the beam enters into the deflector slantwise.

13. The beam current variation system according to claim 4, characterized in that the deflector and the collimator are disaligned in such a way that the beam is dumped in the collimator, when no voltage is applied to the deflector.

14. The beam current variation system according to claim 2, characterized in that the deflector system comprises a first deflector, arranged upstream from the collimator, and a second deflector, arranged downstream from the collimator, wherein the beam is dumped in the collimator, when the first deflector is not powered, and wherein the beam passes through the collimator, when the first deflector is suitably powered, and wherein the second deflector changes the beam direction towards an original beam direction which the beam had before entering the first deflector.

* * * * *